US006184853B1

(12) United States Patent
Hebiguchi et al.

(10) Patent No.: US 6,184,853 B1
(45) **Date of Patent: *Feb. 6, 2001**

(54) METHOD OF DRIVING DISPLAY DEVICE

(75) Inventors: Hiroyuki Hebiguchi; Tatsumi Fujiyoshi, both of Miyagi-ken (JP)

(73) Assignee: Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/023,230

(22) Filed: Feb. 12, 1998

(30) Foreign Application Priority Data

Feb. 13, 1997 (JP) ..... 9-029377

(51) Int. Cl.[7] ..... G09G 3/36

(52) U.S. Cl. ..... 345/88; 345/149; 345/150; 345/152; 345/154

(58) Field of Search ..... 345/150, 100, 345/214, 205, 51, 55, 67, 72, 103, 87, 149, 88, 152, 154

(56) References Cited

U.S. PATENT DOCUMENTS 5,122,783 * 6/1992 Bassetti, Jr. ..... 345/149
5,151,689 * 9/1992 Kabuto et al. ..... 345/103
5,233,447 * 8/1993 Kuribayashi et al. ..... 345/97
5,689,283 * 11/1997 Shirochi ..... 345/132
5,786,798 * 7/1998 Kasai et al. ..... 345/89
5,900,857 * 5/1999 Kuwata et al. ..... 345/100
6,040,826 * 3/2000 Furukawa ..... 345/196

FOREIGN PATENT DOCUMENTS 07199866 8/1995 (JP) .

* cited by examiner

*Primary Examiner*—Richard A. Hjerpe
*Assistant Examiner*—Henry N. Tran
(74) *Attorney, Agent, or Firm*—Brinks Hofer Gilson & Lione

(57) ABSTRACT

A driving method is provided in which power consumption is reduced in a driving circuit system and which does not cause a decrease in the image quality in a display device in which pixels which display one color by combining a plurality of basic colors are arrayed and matrix-driven. This method is used to drive a display device in which a large number of pixels which display a color by combining a plurality of basic colors are arrayed, the large number of pixels are matrix-driven by a large number of scanning lines and a large number of signal lines, the combination of the plurality of basic colors is repeatedly arrayed along the direction of each signal line, and the number of scanning lines is determined at a number such that the number of corresponding pixels arrayed along one signal line is multiplied by the number of basic colors, the method including the steps of: dividing one frame of pixel display information into fields of a number equal to or greater than the number of basic colors, and scanning a reduced number of the scanning lines and displaying the basic colors at the same rate within each field.

6 Claims, 20 Drawing Sheets

FIG. 3

| SCANNING LINE NO. \ SIGNAL LINE NO. | 1 | 2 | 3 |
|---|---|---|---|
| 1 | R | R | R |
| 2 | G | G | G |
| 3 | B | B | B |
| 4 | R | R | R |
| 5 | G | G | G |
| 6 | B | B | B |
| 7 | R | R | R |
| 8 | G | G | G |
| 9 | B | B | B |

FIG. 4

| SCANNING LINE NO. \ SIGNAL LINE NO. | 1 | 2 | 3 |
|---|---|---|---|
| 1 | R | B | G |
| 2 | G | R | B |
| 3 | B | G | R |
| 4 | R | B | G |
| 5 | G | R | B |
| 6 | B | G | R |
| 7 | R | B | G |
| 8 | G | R | B |
| 9 | B | G | R |

FIG. 9

| | | | | | |
|---|---|---|---|---|---|
| R | B | G | R | B | G |
| G | R | B | G | R | B |
| B | G | R | B | G | R |
| R | B | G | R | B | G |
| G | R | B | G | R | B |
| B | G | R | B | G | R |
| R | B | G | R | B | G |
| G | R | B | G | R | B |
| B | G | R | B | G | R |

FIG. 10

| | | | | | | |
|---|---|---|---|---|---|---|
| n | R+ | R- | R+ | R- | R+ | R- |
| | G | G | G | G | G | G |
| | B | B | B | B | B | B |
| n+1 | R | R | R | R | R | R |
| | G- | G+ | G- | G+ | G- | G+ |
| | B | B | B | B | B | B |
| n+2 | R | R | R | R | R | R |
| | G | G | G | G | G | G |
| | B+ | B- | B+ | B- | B+ | B- |
| n+3 | R- | R+ | R- | R+ | R- | R+ |
| | G | G | G | G | G | G |
| | B | B | B | B | B | B |
| n+4 | R | R | R | R | R | R |
| | G+ | G- | G+ | G- | G+ | G- |
| | B | B | B | B | B | B |
| n+5 | R | R | R | R | R | R |
| | G | G | G | G | G | G |
| | B- | B+ | B- | B+ | B- | B+ |

FIG. 11

| | | | | | | |
|---|---|---|---|---|---|---|
| | R | R | R | R | R | R |
| n | G+ | G- | G+ | G- | G+ | G- |
| | B | B | B | B | B | B |
| | R | R | R | R | R | R |
| n+1 | G | G | G | G | G | G |
| | B- | B+ | B- | B+ | B- | B+ |
| | R+ | R- | R+ | R- | R+ | R- |
| n+2 | G | G | G | G | G | G |
| | B | B | B | B | B | B |
| | R | R | R | R | R | R |
| n+3 | G- | G+ | G- | G+ | G- | G+ |
| | B | B | B | B | B | B |
| | R | R | R | R | R | R |
| n+4 | G | G | G | G | G | G |
| | B+ | B- | B+ | B- | B+ | B- |
| | R- | R+ | R- | R+ | R- | R+ |
| n+5 | G | G | G | G | G | G |
| | B | B | B | B | B | B |

FIG. 12

| | | | | | | |
|---|---|---|---|---|---|---|
| n | R | R | R | R | R | R |
| | G | G | G | G | G | G |
| | B+ | B- | B+ | B- | B+ | B- |
| n+1 | R- | R+ | R- | R+ | R- | R+ |
| | G | G | G | G | G | G |
| | B | B | B | B | B | B |
| n+2 | R | R | R | R | R | R |
| | G+ | G- | G+ | G- | G+ | G- |
| | B | B | B | B | B | B |
| n+3 | R | R | R | R | R | R |
| | G | G | G | G | G | G |
| | B- | B+ | B- | B+ | B- | B+ |
| n+4 | R+ | R- | R+ | R- | R+ | R- |
| | G | G | G | G | G | G |
| | B | B | B | B | B | B |
| n+5 | R | R | R | R | R | R |
| | G- | G+ | G- | G+ | G- | G+ |
| | B | B | B | B | B | B |

FIG. 13A

| | | | | | | |
|---|---|---|---|---|---|---|
| r | R | R | R | R | R | R |
| | G | G | G | G | G | G |
| | B | B | B | B | B | B |
| | R | R | R | R | R | R |
| r+1 | G | G | G | G | G | G |
| | B | B | B | B | B | B |
| | R | R | R | R | R | R |
| | G | G | G | G | G | G |
| r+2 | B | B | B | B | B | B |
| | R | R | R | R | R | R |
| | G | G | G | G | G | G |
| | B | B | B | B | B | B |
| r+3 | R | R | R | R | R | R |
| | G | G | G | G | G | G |
| | B | B | B | B | B | B |
| | R | R | R | R | R | R |
| r+4 | G | G | G | G | G | G |
| | B | B | B | B | B | B |
| | R | R | R | R | R | R |
| | G | G | G | G | G | G |
| r+5 | B | B | B | B | B | B |
| | R | R | R | R | R | R |
| | G | G | G | G | G | G |
| | B | B | B | B | B | B |

FIG. 13B

| | | | | | | |
|---|---|---|---|---|---|---|
| r | R | R | R | R | R | R |
| | G | G | G | G | G | G |
| | B | B | B | B | B | B |
| | R | R | R | R | R | R |
| r+1 | G | G | G | G | G | G |
| | B | B | B | B | B | B |
| | R | R | R | R | R | R |
| | G | G | G | G | G | G |
| r+2 | B | B | B | B | B | B |
| | R | R | R | R | R | R |
| | G | G | G | G | G | G |
| | B | B | B | B | B | B |
| r+3 | R | R | R | R | R | R |
| | G | G | G | G | G | G |
| | B | B | B | B | B | B |
| | R | R | R | R | R | R |
| r+4 | G | G | G | G | G | G |
| | B | B | B | B | B | B |
| | R | R | R | R | R | R |
| | G | G | G | G | G | G |
| r+5 | B | B | B | B | B | B |
| | R | R | R | R | R | R |
| | G | G | G | G | G | G |
| | B | B | B | B | B | B |

FIG. 14A

| | | | | | | |
|---|---|---|---|---|---|---|
| r | R | R | R | R | R | R |
| | G | G | G | G | G | G |
| | B | B | B | B | B | B |
| | R | R | R | R | R | R |
| r+1 | G | G | G | G | G | G |
| | B | B | B | B | B | B |
| | R | R | R | R | R | R |
| | G | G | G | G | G | G |
| r+2 | B | B | B | B | B | B |
| | R | R | R | R | R | R |
| | G | G | G | G | G | G |
| | B | B | B | B | B | B |
| r+3 | R | R | R | R | R | R |
| | G | G | G | G | G | G |
| | B | B | B | B | B | B |
| | R | R | R | R | R | R |
| r+4 | G | G | G | G | G | G |
| | B | B | B | B | B | B |
| | R | R | R | R | R | R |
| | G | G | G | G | G | G |
| r+5 | B | B | B | B | B | B |
| | R | R | R | R | R | R |
| | G | G | G | G | G | G |
| | B | B | B | B | B | B |

FIG. 14B

| | | | | | | |
|---|---|---|---|---|---|---|
| r | R | R | R | R | R | R |
| | G | G | G | G | G | G |
| | B | B | B | B | B | B |
| | R | R | R | R | R | R |
| r+1 | G | G | G | G | G | G |
| | B | B | B | B | B | B |
| | R | R | R | R | R | R |
| | G | G | G | G | G | G |
| r+2 | B | B | B | B | B | B |
| | R | R | R | R | R | R |
| | G | G | G | G | G | G |
| | B | B | B | B | B | B |
| r+3 | R | R | R | R | R | R |
| | G | G | G | G | G | G |
| | B | B | B | B | B | B |
| | R | R | R | R | R | R |
| r+4 | G | G | G | G | G | G |
| | B | B | B | B | B | B |
| | R | R | R | R | R | R |
| | G | G | G | G | G | G |
| r+5 | B | B | B | B | B | B |
| | R | R | R | R | R | R |
| | G | G | G | G | G | G |
| | B | B | B | B | B | B |

FIG. 16A

| | | | | | | |
|---|---|---|---|---|---|---|
| s | R | R | R | R | R | R |
| | G | G | G | G | G | G |
| | B | B | B | B | B | B |
| | R | R | R | R | R | R |
| | G | G | G | G | G | G |
| s+1 | B | B | B | B | B | B |
| | R | R | R | R | R | R |
| | G | G | G | G | G | G |
| | B | B | B | B | B | B |
| | R | R | R | R | R | R |
| s+2 | G | G | G | G | G | G |
| | B | B | B | B | B | B |
| | R | R | R | R | R | R |
| | G | G | G | G | G | G |
| | B | B | B | B | B | B |
| s+3 | R | R | R | R | R | R |
| | G | G | G | G | G | G |
| | B | B | B | B | B | B |
| | R | R | R | R | R | R |
| | G | G | G | G | G | G |
| s+4 | B | B | B | B | B | B |
| | R | R | R | R | R | R |
| | G | G | G | G | G | G |
| | B | B | B | B | B | B |

FIG. 16B

| | | | | | | |
|---|---|---|---|---|---|---|
| s | R | R | R | R | R | R |
| | G | G | G | G | G | G |
| | B | B | B | B | B | B |
| | R | R | R | R | R | R |
| | G | G | G | G | G | G |
| s+1 | B | B | B | B | B | B |
| | R | R | R | R | R | R |
| | G | G | G | G | G | G |
| | B | B | B | B | B | B |
| | R | R | R | R | R | R |
| s+2 | G | G | G | G | G | G |
| | B | B | B | B | B | B |
| | R | R | R | R | R | R |
| | G | G | G | G | G | G |
| | B | B | B | B | B | B |
| s+3 | R | R | R | R | R | R |
| | G | G | G | G | G | G |
| | B | B | B | B | B | B |
| | R | R | R | R | R | R |
| | G | G | G | G | G | G |
| s+4 | B | B | B | B | B | B |
| | R | R | R | R | R | R |
| | G | G | G | G | G | G |
| | B | B | B | B | B | B |

FIG. 17A

| | | | | | | |
|---|---|---|---|---|---|---|
| | R | R | R | R | R | R |
| | G | G | G | G | G | G |
| s → | B | B | B | B | B | B |
| | R | R | R | R | R | R |
| | G | G | G | G | G | G |
| | B | B | B | B | B | B |
| | R | R | R | R | R | R |
| s+1 → | G | G | G | G | G | G |
| | B | B | B | B | B | B |
| | R | R | R | R | R | R |
| | G | G | G | G | G | G |
| | B | B | B | B | B | B |
| s+2 → | R | R | R | R | R | R |
| | G | G | G | G | G | G |
| | B | B | B | B | B | B |
| | R | R | R | R | R | R |
| | G | G | G | G | G | G |
| s+3 → | B | B | B | B | B | B |
| | R | R | R | R | R | R |
| | G | G | G | G | G | G |
| | B | B | B | B | B | B |
| | R | R | R | R | R | R |
| s+4 → | G | G | G | G | G | G |
| | B | B | B | B | B | B |

FIG. 17B

| | | | | | | |
|---|---|---|---|---|---|---|
| | R | R | R | R | R | R |
| | G | G | G | G | G | G |
| s | B | B | B | B | B | B |
| → | R | R | R | R | R | R |
| | G | G | G | G | G | G |
| | B | B | B | B | B | B |
| | R | R | R | R | R | R |
| s+1 | G | G | G | G | G | G |
| → | B | B | B | B | B | B |
| | R | R | R | R | R | R |
| | G | G | G | G | G | G |
| | B | B | B | B | B | B |
| s+2 | R | R | R | R | R | R |
| → | G | G | G | G | G | G |
| | B | B | B | B | B | B |
| | R | R | R | R | R | R |
| | G | G | G | G | G | G |
| s+3 | B | B | B | B | B | B |
| → | R | R | R | R | R | R |
| | G | G | G | G | G | G |
| | B | B | B | B | B | B |
| | R | R | R | R | R | R |
| s+4 | G | G | G | G | G | G |
| → | B | B | B | B | B | B |

FIG. 18

| | | | | | | |
|---|---|---|---|---|---|---|
| s | R | R | R | R | R | R |
| | G | G | G | G | G | G |
| | B | B | B | B | B | B |
| | R | R | R | R | R | R |
| | G | G | G | G | G | G |
| s+1 | B | B | B | B | B | B |
| | R | R | R | R | R | R |
| | G | G | G | G | G | G |
| | B | B | B | B | B | B |
| | R | R | R | R | R | R |
| s+2 | G | G | G | G | G | G |
| | B | B | B | B | B | B |
| | R | R | R | R | R | R |
| | G | G | G | G | G | G |
| | B | B | B | B | B | B |
| s+3 | R | R | R | R | R | R |
| | G | G | G | G | G | G |
| | B | B | B | B | B | B |
| | R | R | R | R | R | R |
| | G | G | G | G | G | G |
| s+4 | B | B | B | B | B | B |
| | R | R | R | R | R | R |
| | G | G | G | G | G | G |
| | B | B | B | B | B | B |

METHOD OF DRIVING DISPLAY DEVICE

BACKGROUND OF THE INVENTION

1. Field of the Invention

The present invention relates to a method of driving a matrix driving display device which displays one color by combining a plurality of basic colors, for example, red (R), green (R), and blue (B).

2. Description of the Related Art

Hitherto, a liquid-crystal display device has been known in which a display element, such as a liquid crystal, is used, and this is combined with a light source and color filters, making color display possible.

Here, a description will be given below using a liquid-crystal display device of the following thin-film transistor driving method as an example: in color filters, a pixel which displays one color is formed by combining and using the three basic colors of R, G, and B each as a dot, a large number of these pixels are arrayed in a display area, and further, signal lines and scanning lines are wired in a matrix form in order to drive the liquid crystal, pixel electrodes are arranged in an area which is partitioned by the signal lines and scanning lines, switching of the pixel electrodes is performed by thin-film transistors and an electric field is applied to a liquid crystal corresponding to each dot, causing the transmittance of the liquid crystal to vary so as to switch between display and non-display.

In a display device for a computer to which this type of liquid-crystal display device is applied, in a VGA (Video Graphics Array) display device which makes a display of 640 (horizontal)×480 (vertical) dots, the number of pixels (one pixel being formed by a set of each one of the dots R, G. and B), which is the display unit, is 640×480=307,200, and since these are divided into three parts along the signal lines, the number of scanning lines are 480, and the number of signal lines are 640×3=1,920. Therefore, the total number of dots is 640×3×480=921,600.

FIG. 20 shows a color liquid-crystal drive unit having a driving LSI mounted to the screen of this type of color liquid-crystal display device. In FIG. 20, reference numeral 1 denotes a liquid-crystal display device in which a liquid crystal is sealed between two transparent substrates disposed in such a manner as to face each other, a common electrode and color filters are provided on one transparent substrate, a large number of signal lines along the vertical direction and a large number of scanning lines along the horizontal direction are wired in a matrix form on the other transparent substrate, and pixel electrodes and thin-film transistors are provided in an area which is surrounded and partitioned by the signal lines and the scanning lines. In this example, a plurality of gate drivers Gd for driving scanning lines are mounted on the side of the left-side section of the liquid-crystal display device 1, and a plurality of source drivers Sd for driving signal lines are mounted on each of the upper-edge side and the low-edge side.

FIG. 21 shows the circuit configuration of the liquid-crystal display device 1 of this example. In the circuit of this example, a large number of signal lines $S_1$, $S_2$, $S_3$ in vertical sequences, and scanning lines $G_1$, $G_2$ in horizontal sequences are formed on the circuit of this example in such a manner as to intersect each other, with pixel electrodes 5 and thin-film transistors 6 being provided in areas partitioned by the signal lines and scanning lines, one area having the pixel electrode 5 formed therein is made to represent one dot, and a set of three dots is made to represent one pixel.

Therefore, in the circuit shown in FIG. 20, since a pixel 7 such as that surrounded by the chain line in FIG. 21 is formed, in the VGA display device described above, 307, 200 of these pixels 7 are formed on one screen.

The source drivers Sd and the gate drivers Gd provided in the liquid-crystal display device 1 having such a number of dots are ordinarily formed from one LSI having about 240 output pins. Therefore, the mounting of the LSI on a transparent substrate of the liquid-crystal display device 1 is conventionally in the form of TCP (Tape Carrier Package) which uses an LSI mounted onto polyimide tape, or in the form of COG (Chip on Glass) which directly mounts an LSI.

Therefore, in order to handle 1,920 signal lines and 480 scanning lines used in the liquid-crystal display device 1, as shown in FIG. 20, it is necessary to use 8 (240×8=1,920) source drivers Sd with 240 pins and 2 (240×2=480) gate drivers Gd with 240 pins. Although in an actual liquid-crystal display device, in addition to these, a circuit for providing a signal or the like to a driver is required separately, a description thereof has been omitted here.

Here, regarding power consumption of the drivers, it is assumed that the power consumption of the source driver Sd is larger than that of the gate driver Gd, as will be described below.

Driver power consumption (approximately 840 mW)
- Gate driver Low (approximately 20 mW×2=40 mW: occupies 5%)
- Source driver High (approximately 100 mW×8=800 mW: occupies 95%)

It is also known that the unit price of the source driver is generally more expensive by approximately twice than that of the gate driver.

At present, the power consumption of the source driver is a typical power consumption of 6 bits (number of gradations: 64) in color display. In the case of 8 bits, both the price and the power consumption are increased in values, and the differences in price and power consumption between the gate driver and the source driver become larger. Against the above background, in order to achieve a lower cost and a lower consumption of power of a liquid-crystal display device in which progress is being made towards a larger screen and a larger number of gradations, it is desirable to reduce the number of these expensive drivers required.

Further, if, in the exchange for the achievement of a low power consumption, the image quality deteriorates because of flicker or the like, this deterioration becomes markedly conspicuous because the screen is large. Therefore, it is necessary to achieve a lower power consumption and to maintain the quality of images.

An object of the present invention, which has been achieved in view of the above-described circumstances, is to provide a driving method which reduces the power consumption of a driving circuit system and which does not cause a decrease in the image quality in a display device in which pixels are arrayed such that a plurality of basic colors are combined to display one color and are matrix-driven.

To achieve the above-described object, according to the present invention, there is provided a method of driving a display device, in which a large number of pixels which display colors by combining a plurality of basic colors are arrayed, the large number of pixels are matrix-driven by a large number of scanning lines and a large number of signal lines, and the combinations of the plurality of basic colors are arrayed repeatedly along the direction of each signal line, and the number of scanning lines is determined at a number such that the number of corresponding pixels arrayed along one signal line is multiplied by the number of basic colors, the driving method comprising the steps of: dividing one frame of pixel display information into fields of a number equal to or greater than the number of basic colors; and scanning a reduced number of the scanning lines and displaying the basic colors at the same rate within each field.

Further, one frame described above is divided into the same number of fields as the number of the basic colors, and one frame described above is divided into fields of a number which cannot be divided by the number of the basic colors.

According to the present invention, there are the advantages that since one frame is divided into a plurality of fields and scanning is performed for each field, it is possible to drive a display device in the same way as when driving a conventional construction and to reduce the consumption of power.

Further, since scanning is performed so that the mutually different basic colors are displayed for each scanning line in the fields and that the frame is formed of fields for the number of basic colors, the display color being different for each field, it is possible to prevent flicker and the like. Specifically, there is the advantage that a display can be made such that it can be viewed very easily.

The above and further objects, aspects and novel features of the invention will become more apparent from the following detailed description when read in connection with the accompanying drawings.

BRIEF DESCRIPTION OF THE DRAWINGS

FIG. 3 shows an example of RGB placement of color filters in the construction shown in FIG. 2;

FIG. 4 shows another example of RGB placement of color filters in the construction shown in FIG. 2;

FIG. 9 is an illustration of problems which occur when the liquid-crystal display device of the construction shown in FIG. 4 is driven;

FIG. 10 is an illustration which shows a method of driving the display device according to the present invention;

FIG. 11 is an illustration which shows the method of driving the display device according to the present invention;

FIG. 12 is an illustration which shows the method of driving the display device according to the present invention;

FIG. 13 which is comprised at FIGS. 13A and 13B, provide an illustration which shows another method of driving the display device according to the present invention;

FIG. 14 which is comprised at FIGS. 14A and 14B, provide an illustration which shows the method of driving the display device according to the present invention;

FIG. 16 which is comprised at FIGS. 16A and 16B, provide an illustration which shows still another method of driving the display device according to the present invention;

FIG. 17 which is comprised at FIGS. 17A and 17B, provide an illustration which shows the method of driving the display device according to the present invention;

FIG. 18 is an illustration which shows the method of driving the display device according to the present invention;

DESCRIPTION OF THE PREFERRED EMBODIMENTS

The preferred embodiments of the present invention will be described below with reference to the accompanying drawings.

A driving apparatus to which a driving method of the present invention is applied will be described first.

Figure 1:
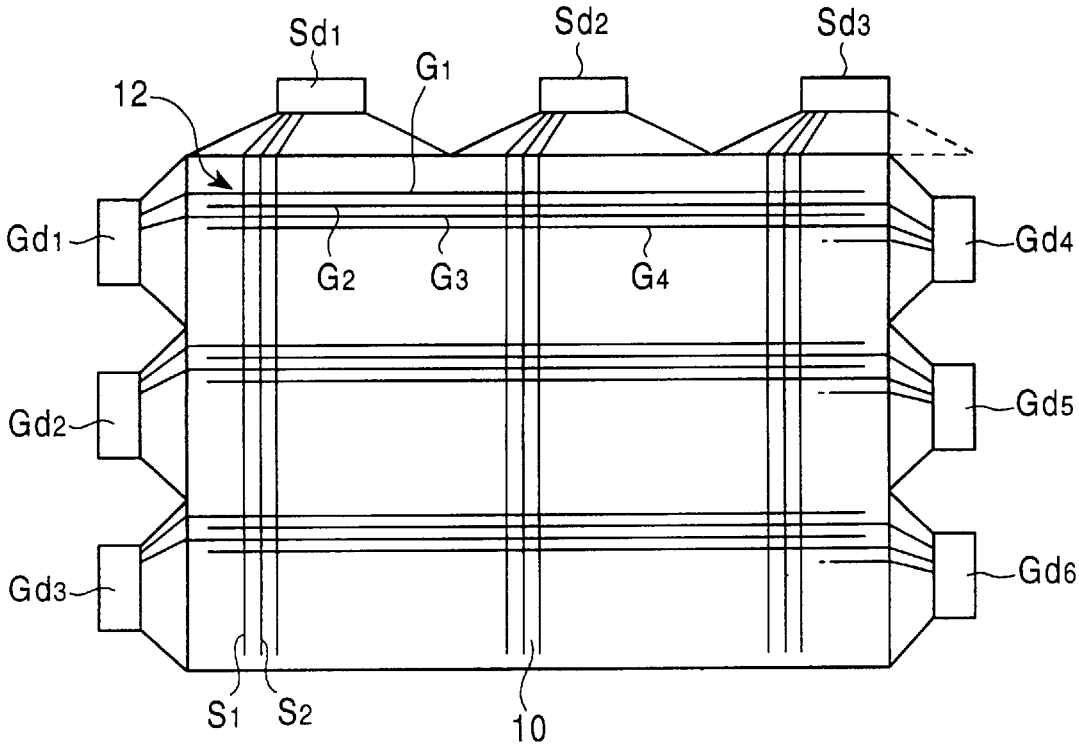
FIG. 1 shows an embodiment of a liquid-crystal display device to which the present invention is applied.

FIG. 1 shows an embodiment of a liquid-crystal display device to which the present invention is applied. In this embodiment, a liquid crystal is sealed between two transparent substrates, and a liquid-crystal display device 10 is formed. Three source drivers Sd ($Sd_1$ to $Sd_3$) are provided in the upper-edge section of a transparent substrate of this liquid-crystal display device 10, and three gate drivers Gd ($Gd_1$ to $Gd_3$) are provided in the left-side section of the transparent substrate of the liquid-crystal display device 10, and three gate drivers Gd ($Gd_4$ to $Gd_6$) are provided in the the right-side section.

Next, of two transparent substrates which form the liquid-crystal display device 10, a common electrode and color filters are provided on one transparent substrate, and a thin-film transistor circuit is formed on the other transparent substrate. A portion corresponding to one pixel of the circuit configuration is shown in the enlarged view of FIG. 2.

One pixel 12 in this embodiment is formed of areas partitioned by two signal lines $S_1$ and $S_2$ in vertical sequences and four scanning lines $G_1$, $G_2$, $G_3$, and $G_4$ in horizontal sequences. One pixel electrode 11 is provided in the area surrounded by the signal lines $S_1$ and $S_2$ and the scanning lines $G_1$ and $G_2$, and this area represents one dot. Another pixel electrode 11 is provided in the area surrounded by the signal lines $S_1$ and $S_2$ and the scanning lines $G_2$ and $G_3$, and this area represents one dot. A third pixel electrode 11 is provided in the area surrounded by the signal lines $S_1$ and $S_2$ and the scanning lines $G_3$ and $G_4$, and this area represents one dot. These three dots form one pixel 12, and a thin-film transistor T serving as a switching element is formed on the side section of each pixel electrode 11.

Figure 2:
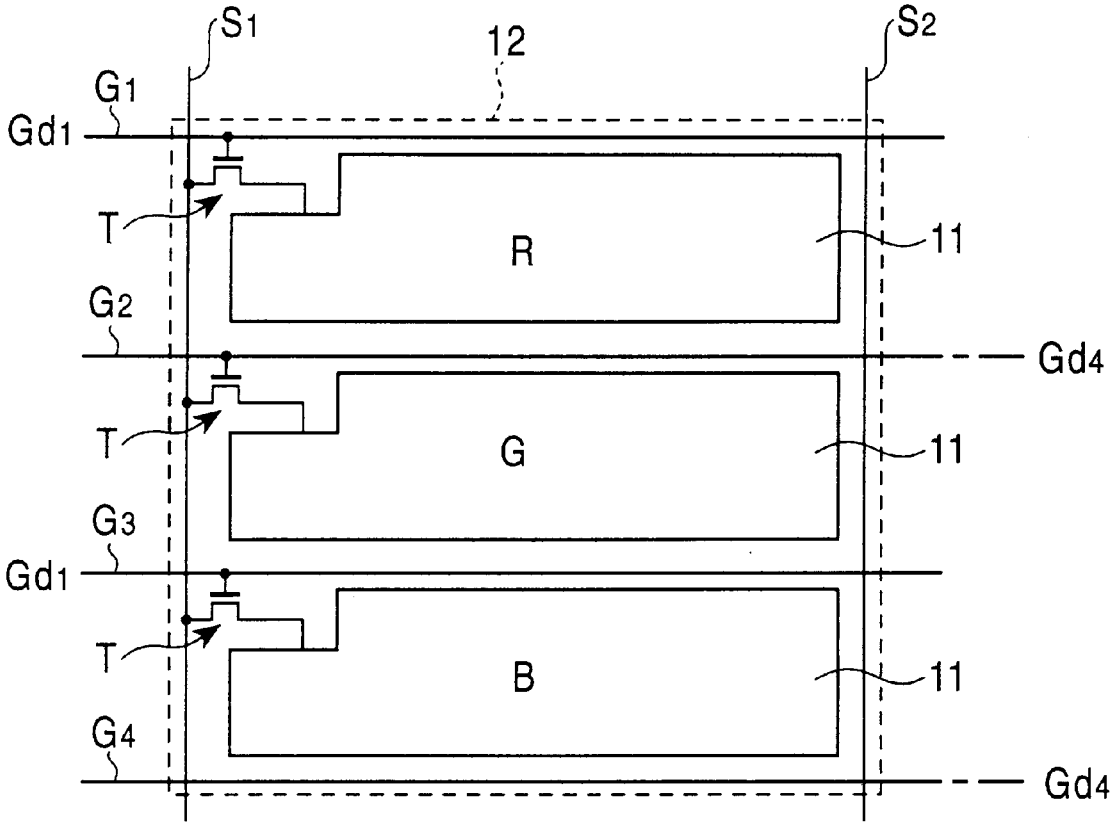
FIG. 2 is an enlarged view showing the relationship between the pixels and the thin-film transistor structure of the display device shown in FIG. 1.

Further, color filters are provided on the other substrate facing the substrate on which the pixel electrodes 11 are formed. In this embodiment, for one pixel shown in FIG. 2, a color filter of R is placed at the position facing the upper-stage pixel electrode 11, as shown in FIG. 2, a color filter of G is disposed at the position facing the middle-stage pixel electrode 11, as shown in FIG. 2, and a color filter of B is disposed at the position facing the low-stage pixel electrode 11, as shown in FIG. 2. The placement relationship of RGB of the color filters, including a plurality of other pixels, is shown in FIG. 3. In this embodiment, the color filters are arranged in the sequence of RGB and RGB along the length direction (the up-and-down direction in FIG. 3) of each signal line. Along the direction of the scanning line No. 1, the color filters are arrayed in the sequence of R, R, R . . . , in the sequence of G, G, G . . . along the direction of scanning line No. 2, in the sequence of B, B, B . . . along the direction of scanning line No. 3, in the sequence of R, R, R . . . along the direction of scanning line No. 4, in the sequence of G, G, G . . . along the direction of scanning line No. 5, and in the sequence of B, B, B . . . along the direction of scanning line No. 6 in such a way that the respective color filters correspond to the scanning-line number.

Further, in this embodiment, to produce a VGA display, 640 signal lines S are provided, and 480×3=1,440 scanning lines G are provided. Therefore, in this embodiment, the number of pixels is 640×480=307,200, which is the number of pixels equal to that of the conventional construction shown in FIG. 20, but the number of signal lines is reduced to ⅓ of that of the conventional construction. However, the number of scanning lines is three times (a multiple of the number of basic colors) as many as that of the conventional construction shown in FIG. 20.

With this construction, if a driving LSI with 240 pins comparable with that of the conventional construction is used, it is possible for three source drivers Sd to handle 240×3=720 lines. If it is assumed that a VGA apparatus has 640 lines, an allowance of 80 lines is produced. Therefore, as shown in FIG. 1, three source drivers $Sd_1$ to $Sd_3$ are provided; in practice, all of the terminals of two source drivers Sd and about 160 terminals of the third source driver $Sd_3$ are connected to the signal lines S . . . .

In the gate drivers Gd, since 1,440 scanning lines are required, if an LSI with 240 pins is used, six LSIs are required and therefore, as shown in FIG. 1, six gate drivers $Gd_1$ to $Gd_6$ are provided. The connection of the scanning lines G . . . for the gate driver $Gd_1$ on the upper left side of the transparent substrate and the gate driver $Gd_4$ on the upper right side will now be described. The first and every other scanning lines G . . . are provided for the gate driver $Gd_1$ on the upper left side of the transparent substrate, and every other remaining scanning line G is provided for the gate driver $Gd_4$ on the upper right side. Therefore, a total of 480 gate lines G of $G_1$ to $G_{480}$ are alternately connected to either gate driver $Gd_1$ or $Gd_4$ which face each other on the left and right.

Here, since the source driver Sd is about twice as expensive as the gate driver Gd, a decrease in the number of the expensive source drivers Sd from the conventional eight to three achieves a large reduction in cost. Further, since the gate driver Gd is about half in the unit price of the source driver Sd, unlike two source drivers being required in the conventional construction shown in FIG. 20, even if six source drivers are required in this embodiment and the required cost increases, the amount of increase in the required cost caused thereby is smaller than the amount of reduction in the cost as a result of the reduction in the number of source drivers Sd. Therefore, the result is that a lower cost can be achieved as a result of the reduction in the number of expensive source drivers without changing the number of display pixels.

Further, when the power consumption is considered, if six gate drivers with a power consumption of approximately 20 mW consume 120 mW and three source drivers with a power consumption of approximately 100 mW consume 300 mW, the total power consumption is approximately 420 mW. Thus, the power consumption can be kept to approximately half the approximate 840 mW of the conventional construction.

Meanwhile, a construction can be realized in which at the same time that a thin-film transistor circuit is formed on a transparent substrate by using polysilicon, a thin-film transistor driving circuit is also formed and the driving circuit is contained in the transparent substrates for sealing the liquid crystal. However, the source driver Sd which must process a signal of a large number of gradations of about 6 to 8 bits consumes more power than the gate driver Gd of 1 bit for performing on-off control of the pixel electrodes for liquid-crystal display, and there is a greater number of transistors of the source drivers Sd, presenting the problem of the yield being poor. Therefore, even in the liquid-crystal display device having a driving circuit contained therein, a reduction in the number of signal lines and the number of source drivers Sd greatly contributes to a lower power consumption and an improved yield.

Further, in this embodiment, the RGB color filters are arranged as shown in FIG. 3. However, the RGB arrangement of the color filters is not limited to this example, and it is a matter of course that, as shown in FIG. 4, an arrangement of a repetition of R, B, and G along scanning line No. 1, an arrangement of a repetition of G, R, and B along scanning line No. 2, an arrangement of a repetition of B, G, and R along scanning line No. 3, and an arrangement of a repetition of R, B, and G along scanning line No. 4 may be repeatedly made in such a manner as to correspond to the scanning-line number. In this arrangement, the sequence number of the basic colors arrayed along the signal line Sd is made repeatedly the same along the signal line, and each of the basic colors is arrayed obliquely to the signal lines and the mutually different basic colors are arranged adjacent to each other along the scanning lines.

Next, the R, G, and B arrangement of the patterns shown in FIG. 3 is an arrangement which can be referred to as a horizontal stripe. With this arrangement, when a signal is processed to process a digital image on a personal computer, in particular, when such a process as error diffusion which computes the correlation of the adjacent pixels is performed, advantages can be expected that since the adjacent colors are the same, processing is easy and less memory is required.

Further, the R, G, and B arrangement of the patterns shown in FIG. 4 can be referred to as a mosaic arrangement. In this embodiment, when a video image, such as a landscape, is observed, a horizontal stripe does not occur and therefore, a more natural, smooth image can be obtained.

Next, a description will be given of a case in which a driving circuit is driven in a liquid-crystal display device of the above-described embodiment with reference to FIGS. 1 to 3.

Figure 20:
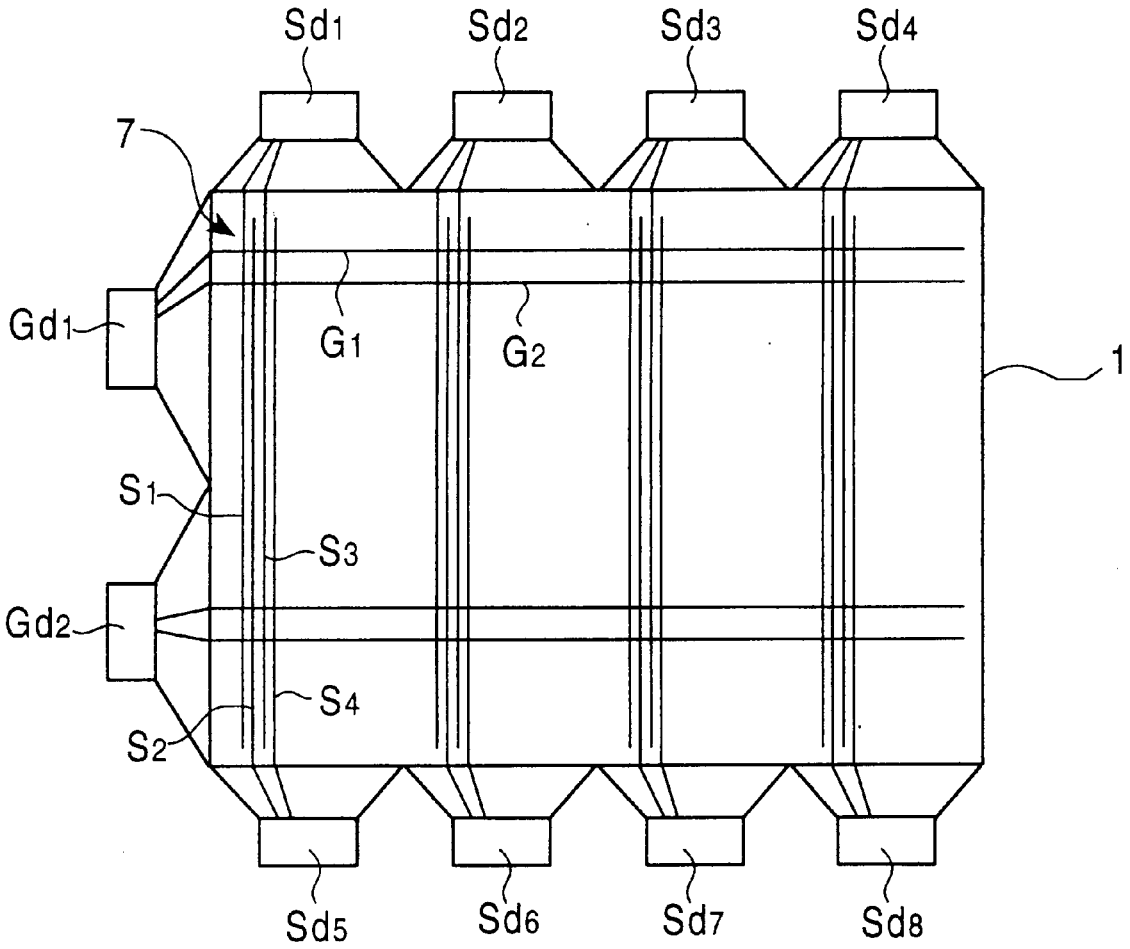
FIG. 20 PRIOR ART
FIG. 20 is a plan view of a conventional liquid-crystal display device.
Figure 21:
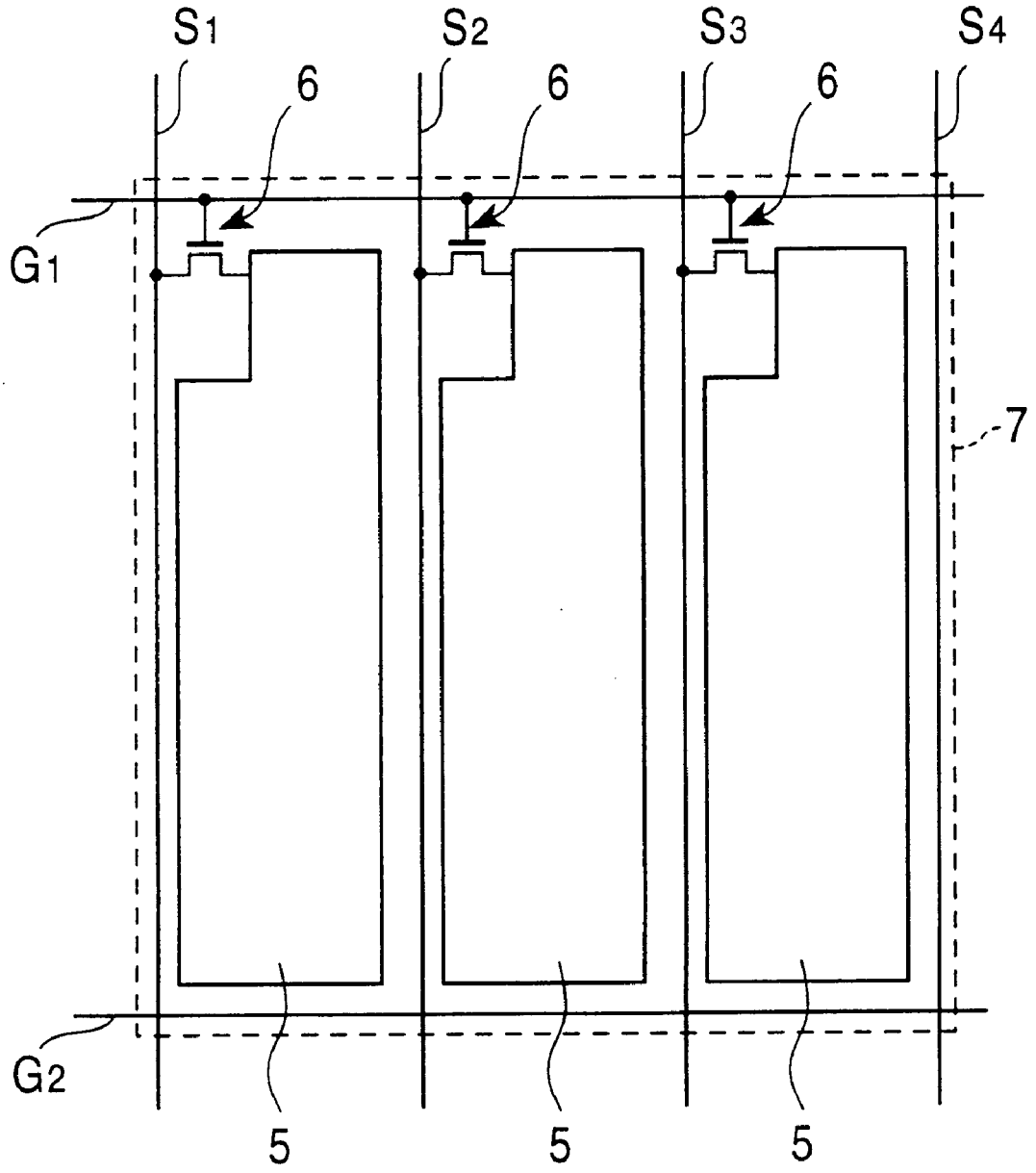
FIG. 21 PRIOR ART
FIG. 21 is an enlarged view of one pixel of the liquid-crystal display device shown in FIG. 20.

The description of a method for driving the liquid-crystal display device of the above-described embodiment will be provided by contrasting it with a method for driving the conventional liquid-crystal display device shown in FIGS. 20 and 21.

When a display of 640×480 dots is produced in VGA in the conventional liquid-crystal display device shown in FIGS. 20 and 21, since the frame frequency is assumed to be 60 Hz (the screen is rewritten 60 times in one second), it takes approximately 16 msec to rewrite one screen. That is, 480 scanning lines are scanned in this period of 16 msec. Therefore, the frequency at which the gate driver Gd scans scanning lines one by one is approximately 30 kHz (approximately 30 μsec per line) at 60 Hz×480 lines.

Meanwhile, regarding the signal lines, since signals for 640 signal lines and a blanking signal are sent to the source driver Sd in a time sequence, a dot clock for reading the signals sent in a time sequence for each dot is approximately 25 MHz.

In comparison, if the frame frequency is 60 Hz in the same way as in the above case by using the liquid-crystal display device having the construction shown in FIGS. 1 and 2, since the number of scanning lines G is three times as many for R, C, and B as that of the conventional construction shown in FIGS. 20 and 21, driving is performed at three times the scanning speed.

Specifically, since the number of scanning lines G is 480×3=1,440 and the signal lines S is 640, the frequency at which the gate driver Gd scans the scanning lines G is 60 Hz×480×3 (lines)=approximately 90 kHz. Here, the conventionally used gate driver is capable of operating up to approximately 100 kHz. From this point of view, the same gate driver as the conventional construction can be used.

Meanwhile, in the construction shown in FIGS. 1 and 2, since the number of signal lines S can be 640, which is ⅓ of that of the conventional construction shown in FIGS. 20 and 21, the dot clock of the source driver Sd is approximately 25 MHz, which is the same as that of the conventional construction.

Therefore, with the construction shown in FIGS. 1 and 2, it is possible to use the gate driver Gd and the source driver Sd having the same construction as the conventional construction shown in FIGS. 20 and 21 as they are.

Next, with the construction shown in FIGS. 1 and 2, the following advantages can be exhibited.

(1) In the construction shown in FIGS. 1 and 2, no deterioration in image quality occurs in comparison with the conventional liquid-crystal display device shown in FIGS. 20 and 21.

That is, when one screen is viewed in relation to space, the number of pixels is 307,200 for both the construction shown in FIG. 1 and the construction shown in FIG. 20, and there occurs no change in resolution. Further, when one screen is viewed in relation to time, the frame frequency is 60 Hz for both the construction shown in FIG. 1 and the construction shown in FIG. 20, and there is also no problem with the display of a moving picture.

(2) In the construction shown in FIGS. 1 and 2, it is possible to use the same gate driver and the same source driver as those of the conventional liquid-crystal display device shown in FIGS. 20 and 21. Furthermore, although the number of inexpensive gate drivers must be increased from two to six, the number of source drivers, which are twice as expensive as the gate drivers, can be decreased from eight to three and therefore, a lower cost can be achieved as a whole.

(3) The power consumption can be reduced.

Regarding the driver power consumption, the power consumption is 120 mW because six gate drivers with power consumptions of approximately 20 mW are required. However, the power consumption per gate driver becomes three times as large because the frequency when the scanning lines are scanned becomes three times as high, and the total power consumption becomes 360 mW. Since three source drivers with power consumptions of approximately 100 mW are required, the power consumption is 300 mW, and a total of 660 mW is required in all. Since approximately 840 mW is required in the conventional construction, the power consumption can be reduced to approximately ⅘ of its value.

Next, with reference to FIG. 6, a description will be given of another embodiment of a driving method when the construction shown in FIGS. 1 and 2 is adopted.

Figure 6:
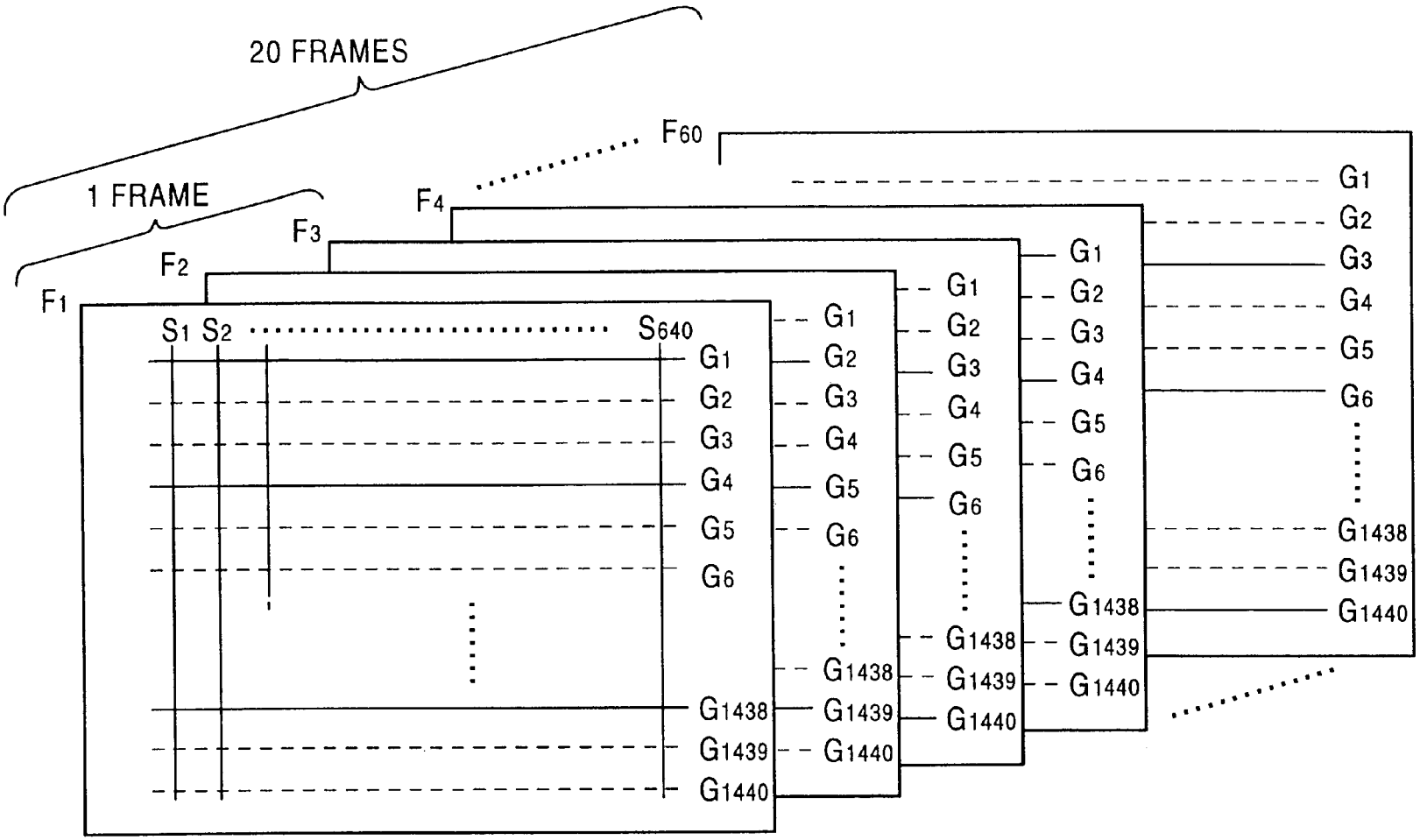
FIG. 6 shows another example of the relationship between the frame frequency and the fields when the display device is driven.

The driving method of this embodiment has a feature in that, as shown in FIG. 6, one frame is divided into three fields, and interlace scanning such that two fields are skipped is performed.

Specifically, one screen is drawn by three fields, the frame frequency is set to 20 Hz and the field frequency is set to 60 Hz (approximately 16 msec), and the number of scanning lines scanned in the interval of one field (approximately 16 msec) is 480, which is ⅓ of the total number of 1,440 scanning lines. Therefore, the frequency at which the gate drivers scan the scanning lines is 60 Hz×480 (lines), which is approximately 30 kHz, this being the same as that in the case of driving in the conventional construction shown in FIGS. 20 and 21, and thus ⅓ of that of the driving method of the above-described embodiment of the present invention. As a consequence, the dot clock becomes 30 kHz×640 (lines), which is approximately 30 kHz, this being the same as that of driving in the conventional construction shown in FIGS. 20 and 21, that is, ⅓ of that of the above-described embodiment of the present invention.

When a driving method such as that described above is adopted, the advantages described below can be obtained.

(1) It is possible to use a gate driver and a source driver comparable to those used in the conventional construction shown in FIGS. 20 and 21. Furthermore, although the number of inexpensive gate drivers must be increased from two to six, the number of expensive source drivers can be decreased from eight to three and therefore, a lower cost can be achieved.

(2) With regard to the driver power consumption, the power consumption is approximately 20 mW, which is the same as that of the conventional construction because the frequency at which the scanning lines are scanned is the same as that in the conventional construction, and since six gate drivers with power consumptions of approximately 20 mW are required, the power consumption becomes 120 mW. Although three source drivers with power consumptions of approximately 100 mW are required, the power consumption per source driver reduces to ⅓ of its value because their dot clock is ⅓ of that of the conventional construction, which results in 100/3 mW, and a total of approximately 220 mW is required in all. Since approximately 840 mW is required in the conventional construction, the power consumption can be reduced to approximately ¼ of its value.

(3) Can be realized with less changes in design of portions of the circuit (the conventional construction can also be used more than the embodiment described earlier). In particular, by dividing one frame into fields for the number of basic colors (the three fields of R, G, and B in the case of this embodiment), by setting the field frequency to 60 Hz, and by scanning with two lines being skipped, the frequency at which the gate drivers scan the signal lines can be approximately 30 kHz at 640×480 lines, which is exactly the same as that of the conventional construction, and the peripheral circuits of the gate driver can be the same as those of the conventional construction.

In each embodiment described above, the case of a liquid-crystal display device using thin-film transistors (TFT-LCD) is described. However, since the same advantages can be expected in the liquid-crystal display device in which pixels which display one color by combining a plurality of basic colors (e.g., R, G, and B) are arrayed and matrix-driven, it is a matter of course that the present invention can be widely applied to a simple-matrix-type liquid-crystal display device, an FED (Field Emission Display), a ferrodielectric liquid-crystal display device, a plasma display, an EL (electroluminescence) display, and so on.

Further, when one pixel is divided into the basic colors, two-color division or four-color division is possible. Therefore, in the case of these divisions, the number of scanning lines may be made two or four times as many as that of the conventional construction, and the arrangement of the color filters may be the above-described horizontal stripe arrangement or mosaic arrangement.

Figure 7:
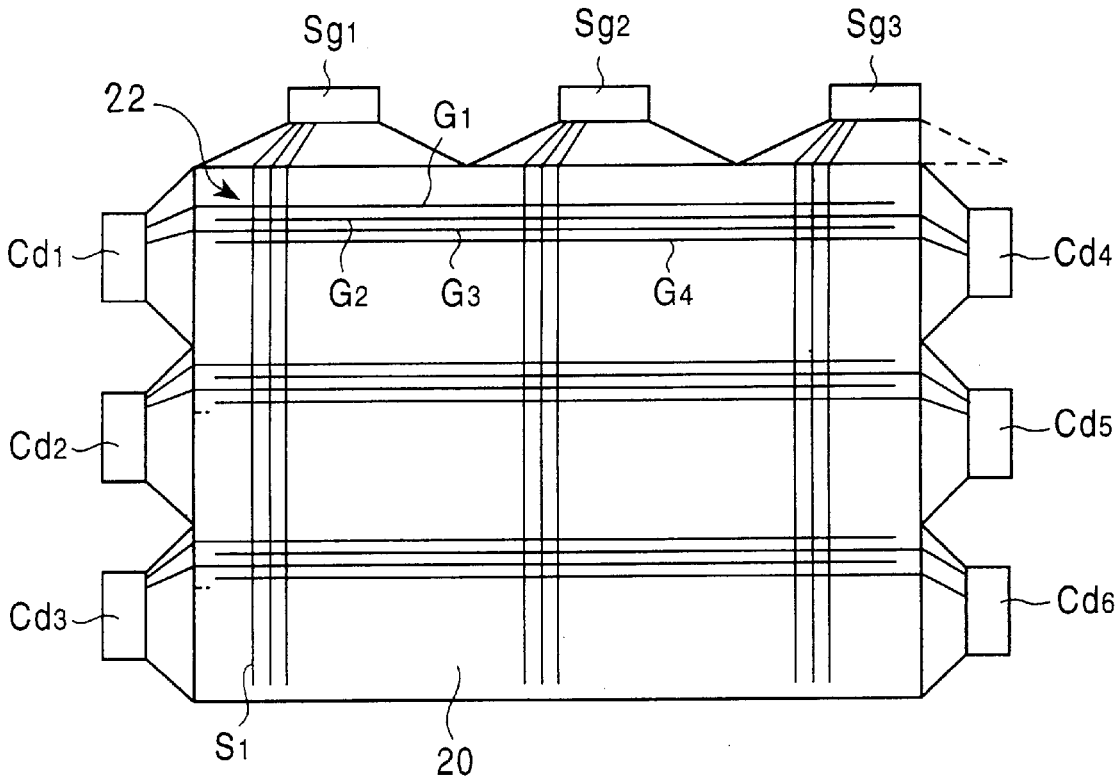
FIG. 7 shows an example of a simple-matrix-type liquid-crystal display device to which the present invention is applied.
Figure 8:
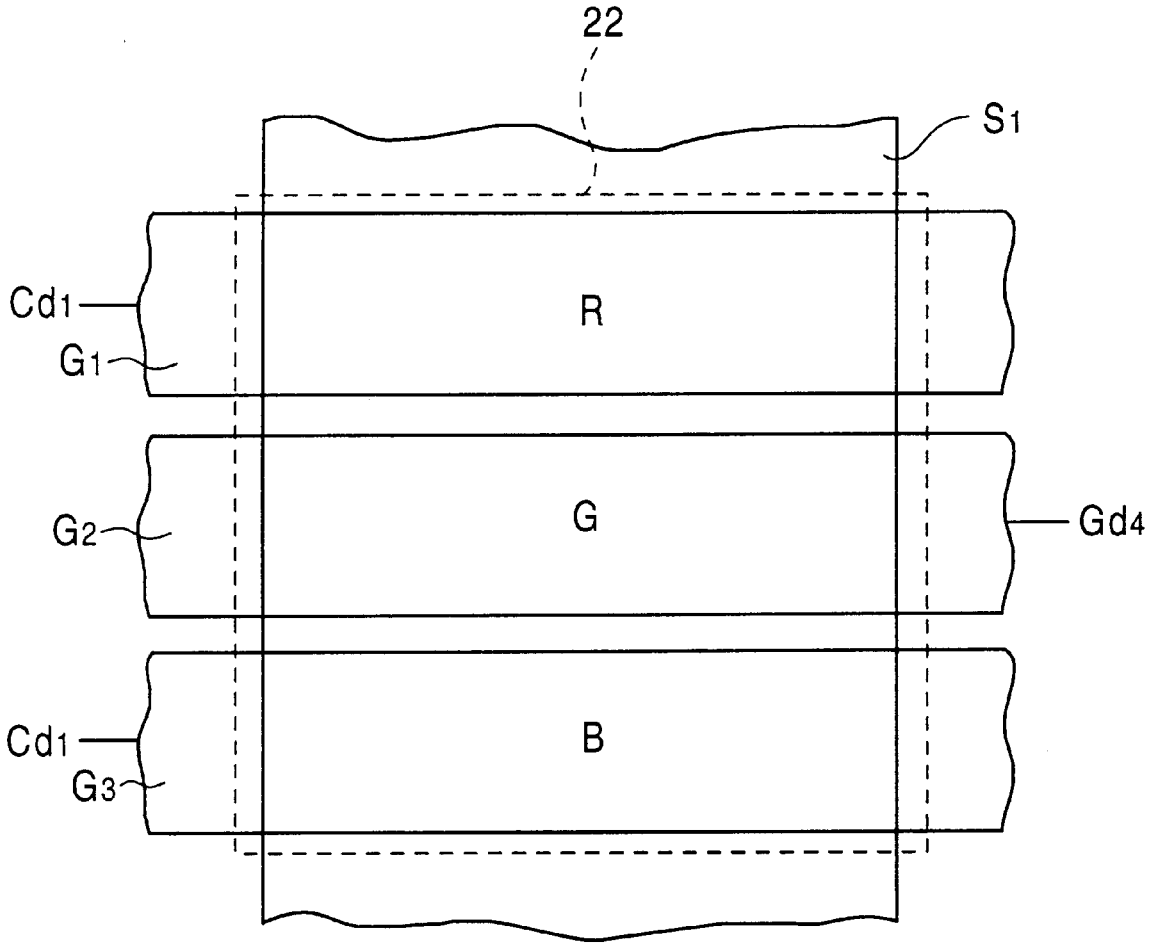
FIG. 8 is an enlarged view of one pixel of the liquid-crystal display device shown in FIG. 7.

FIGS. 7 and 8 show an example of a simple-matrix-type liquid-crystal display device to which the present invention is applied. A liquid crystal is sealed between two transparent substrates, color filters are provided on the liquid crystal side of one transparent substrate, scanning lines $G_1$, $G_2$ made of a transparent conductive layer are opposedly provided on this transparent substrate, and signal lines $S_1$, $S_2$ . . . made of a transparent conductive layer are opposedly provided on the liquid crystal side of the other substrate in such a way that the scanning lines and the signal lines intersect each other, forming a liquid-crystal display device 20. FIG. 8 is an enlarged view of only one pixel 22 shown in FIG. 7. Also in this embodiment, the color filter is divided into three parts according to R, G, and B, and a scanning line G is provided in each of the areas R, G, and B.

Further, segment drivers $Sg_1$, $Sg_2$, and $Sg_3$ are provided in the upper-edge section of the transparent substrate, and the terminal of each driver is connected to the signal lines S, respectively. Three common drivers Cd (a total of six: $Cd_1$ to $Cd_6$) are provided on both edge portions of the right and left of the transparent substrate, respectively, with the terminal of each driver being connected to the scanning lines G, respectively.

Also in this example, in the same way as in the earlier example, the first and every other gate line G of a large number of arranged gate lines G . . . are connected to the common driver Cd on the left side, and every other remaining gate line G is connected to the common driver Cd on the right side.

In this example, a pixel is formed in an area surrounded and partitioned by a signal line S and three scanning lines G, and the pixel is divided into three dots, thereby achieving the object.

As described above, in the simple-matrix-type liquid-crystal display device, an electric field is applied into a liquid crystal present in the intersection portion of the signal lines S and the scanning lines G which opposedly intersect each other, and the liquid crystal is driven. Thus, this portion where the signal line S and the scanning line G intersect each other forms one dot.

In each embodiment described above, the case of a VGA of 640×480 pixels is described. However, in addition to this, there are various screen displays, and it is a matter of course that the present invention can be applied to various standards of a television screen of an NTSC (National Television System Committee) system with 480 scanning lines, a television screen of a PAL (Phase Alteration by Line) system with 570 scanning lines, an PIDTV (High Definition Television) system with 1,125 scanning lines, an SVGA (Super Video Graphics Array) with 600 scanning lines, an XGA (eXtended Graphics Array) with 768 scanning lines, an EWS (Engineering Work Station) with 1,024 lines, and others.

Figure 5:
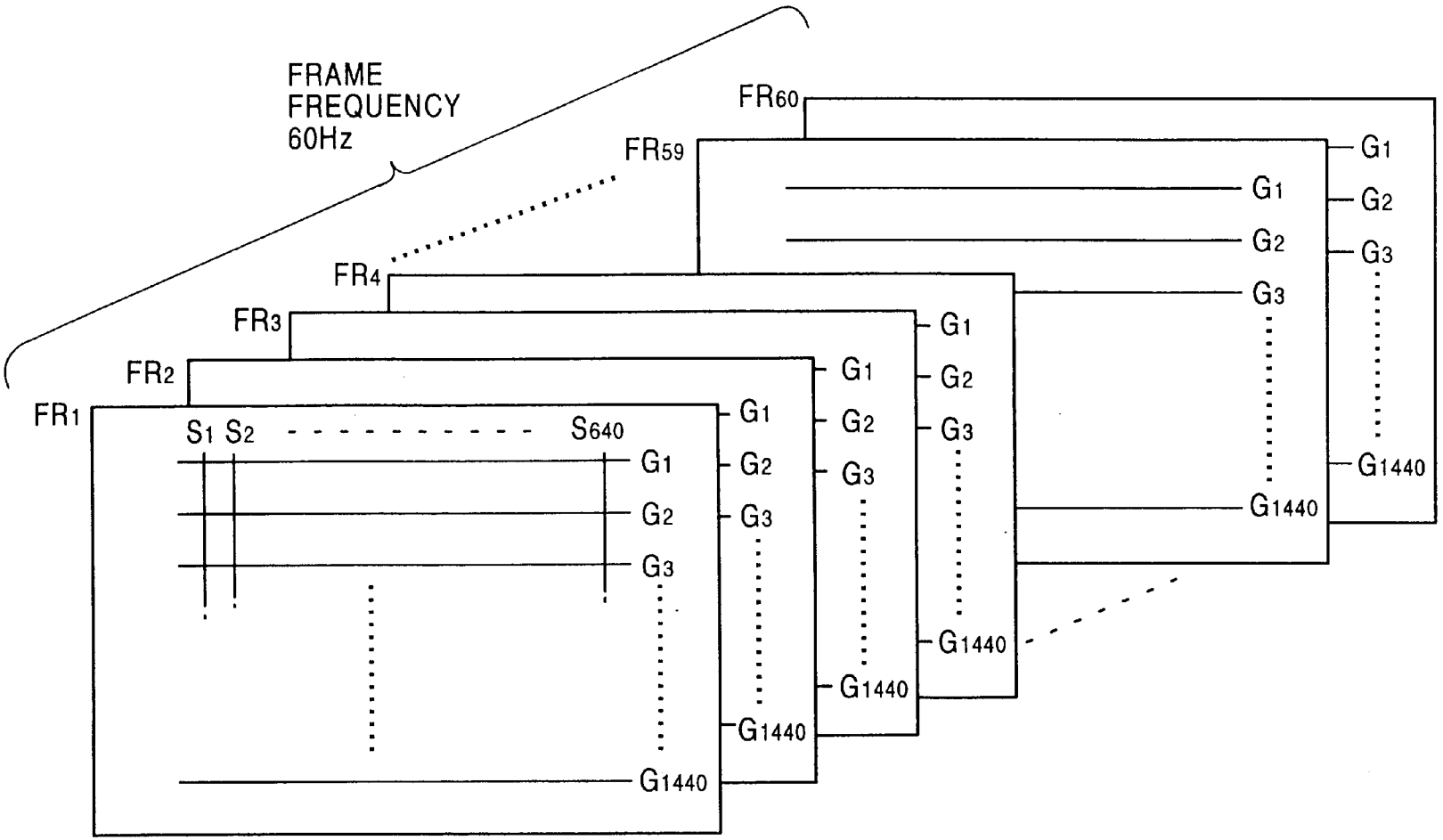
FIG. 5 shows an example of the relationship between the frame frequency and the fields when the display device is driven.

Further, a construction may be used in which the driving method described with reference to FIG. 5 and the driving method described with reference to FIG. 6 are interchangeably used. For example, in the case where the liquid-crystal display device is used for a notebook personal computer, a construction may be used in which a switch is provided around the display device of the notebook personal computer, the driving circuit which performs the driving method described with reference to FIG. 5 and the driving circuit which performs the driving method described with reference to FIG. 6 are switched to change the display state of the display device according to the object of use.

In each embodiment described above, a lower cost, a reduction in power consumption, and the like can be achieved. However, when a driving method shown in FIG. 6, that is, interlace scanning such that one frame is divided into three fields and two fields are skipped, is performed by using the pixels of the horizontal stripe arrangement shown in FIG. 3, new problems arise in that flicker, line scrawling (a phenomenon in which fine streaks are displayed on the screen in such a manner as to flow), or the like occur.

When the driving method shown in FIG. 6 is used by using the pixels of the horizontal stripe arrangement shown in FIG. 3, only the dots of the same color are driven within the same field. That is, in the driving method shown in FIG. 6, one screen (frame) is formed by three fields including a field which displays red, a field which displays green, and a field which displays blue. When the luminance (transmittance) of red, green, and blue is denoted as $T_r$, $T_g$, and $T_b$, respectively, the ratio of the transmittances becomes $T_r:T_g:T_b \approx 3:6:1$. In this case, since the luminance (transmittance) of each color is different, the balance of the luminance (transmittance) is distorted among the fields, and as a result, flicker occurs in the entire display area.

To prevent the above-described flicker, in the case where the same number of dots of each color are driven within one field by using the pixels of the horizontal stripe arrangement shown in FIG. 4, that is, the pixels such that each color is arranged in a mosaic form, the above-described flicker is eliminated. However, for example, as shown in FIG. 9, when a horizontal line of one dot is displayed on the screen, the horizontal line is displayed in the form of steps. That is, using the pixels shown in FIG. 4 causes the problem of the contour of the display object being distorted in the fine portions of the display.

Next, a description will be given of a driving method in which both the problem of the contour of the display object being distorted and the problem of the occurrence of flicker are solved.

FIGS. 10, 11, and 12 are illustrations which show the method of driving a display device according to the present invention. In this driving method, the display device is driven by dividing one frame into three fields. FIG. 10 shows the situation during the driving of the first field. FIG. 11 shows the situation during the driving of the second field. FIG. 12 shows the situation during the driving of the third field. The fields shown in FIGS. 10, 11, and 12 are sequentially driven to display one frame. In this driving method, pixels in the horizontal stripe arrangement shown in FIG. 3 are used. In the following, for the sake of simplicity of description, a case will be described in which a voltage is applied to all the dots which form the screen in order to produce a white display.

In this driving method, in order to solve the above-described problems, driving is performed so that the following conditions are satisfied:

(1) The color arrangement of each pixel is the same for the entire display screen (2) The number of dots of each color driven within the same field is equal The arrows shown on the left in FIGS. 10 to 12 indicate the scanning lines driven in the field. In the first field shown in FIG. 10, only the red, green, and blue dots of the n-th, (n+1)th, and (n+2)th pixels are driven respectively. In the second field shown in FIG. 11, only the green, blue, and red dots of the n-th, (n+1)th, and (n+2)th pixels are driven respectively. In the third field shown in FIG. 12, only the blue, red, and green dots of the n-th, (n+1)th, and (n+2)th pixels are driven respectively. Thereafter, the dots are driven the same in sequence for the (n+3)th, (n+4)th, and (n+5)th pixels.

The symbols "+" and "−" shown in FIGS. 10 to 12 indicate the polarity of the voltage applied to the dot.

Initially, the red dots of the n-th pixels of the first field are driven at a different polarity for each column. That is, as shown in FIG. 10, they are driven sequentially at polarities of "+", "−", "+", "−", . . . . Next, the green dots of the (n+1)th pixels are driven sequentially at polarities of "−", "+", "−", "+", . . . , and the blue dots of the (n+2)th pixels are driven sequentially at polarities of "+", "−", "+", "−", . . . .

In the same way, also in the second and third fields, the dots of one color of the pixels which form each row are driven at a different polarity, displaying one frame.

Also in the next frame, as described above, the dots are driven in the sequence of the first, second, and third fields, and a voltage with a different polarity from that which was previously applied is applied to each dot. For example, the first field will now be described. The red dots of the n-th pixels are sequentially driven at polarities of "+", "−", "+", "−", . . . during the above-described previous driving. But, for this time, they are sequentially driven at a different polarity from that which was last applied, that is, at polarities of "−", "+", "−", "+", . . . . Also in the second and third fields, in the same manner, a voltage of a polarity different from that applied last is applied. In this way, in this driving method, each dot is driven at a different polarity in relation to space (meaning the horizontal and vertical direction of the liquid-crystal display elements), and driven at a different polarity in relation to time.

After a total of six fields described above of the first to third fields and the first to third fields which are driven at a polarity different from that of the above first to third fields, a series of sequences terminate. Hereinafter, this sequence is repeated sequentially.

In the above-described embodiment, the visual recognition of line crawling is prevented as a result of the driving of the adjacent dots on the same scanning line and the dots that the writing time is adjacent to on the same signal line at different polarities. However, the embodiment is not limited to this case, and only the dots on the same scanning line capable of substantially controlling the spatial frequency of the luminance (transmittance) are taken note of, and the cycle (spatial frequency, time frequency) in which the polarity is reversed may be determined in a range in which the visual recognition of line crawling can be prevented.

Next, a description will be given of still another driving method in which both the problem of the contour of the display object being distorted and the problem of the occurrence of flicker are solved.

FIGS. 13 and 14 are illustrations which show the method of driving the display device according to the present invention. The difference between this driving method and the driving method shown in FIGS. 10 to 12 is that one frame is divided into four fields and driven. In the driving method shown in FIGS. 10 to 12, since one frame is divided into three fields, that is, fields of the number of basic colors (red, green, and blue), the scanning lines scanned within one frame are not evenly spaced. However, by dividing one frame into four fields, it is possible to make the scanning lines driven within one field evenly spaced.

Also in this driving method, pixels in the horizontal stripe arrangement shown in FIG. 3 are used. In the following, for the sake of simplicity of description, a case in which a white display is produced by applying a voltage to all the dots which form the screen will be described.

FIG. 13A shows the first field when driven by this driving method. As shown in this figure, in this driving method, the scanning lines are driven at a rate of one for every four scanning lines. That is, as shown in FIG. 13A, in the first field, four scanning lines represent one unit, and the first scanning line of the scanning lines which form each unit is driven. In this case, as shown in the figure, a red scanning line is scanned in the r-th unit, a green scanning line is scanned in the (r+1)th unit, a blue scanning line is scanned in the (r+2)th unit, a red scanning line is scanned in the (r+3)th unit, a green scanning line is scanned in the (r+4)th unit, and a blue scanning line is scanned in the (r+5)th unit in this sequence.

FIG. 13B shows the second field when driven by this method. As shown in this figure, in the second field, the second scanning line of four scanning lines which represent one unit is scanned. In FIG. 13B, the scanning lines are driven sequentially in the sequence of green, blue, red, green, blue, and red in the sequence from the r-th to (r+5)th unit.

FIG. 14A shows the third field when driven by this method. As shown in this figure, in the third field, the third scanning line of four scanning lines which represent one unit is scanned. In FIG. 14A, the scanning lines are driven sequentially in the sequence of blue, red, green, blue, red, and green in the sequence from the r-th to (r+5)th unit.

FIG. 14B shows the fourth field when driven by this method. In this field, the remaining scanning lines are scanned. That is, in the fourth field, the fourth scanning line of four scanning lines which represent one unit is scanned. In FIG. 14B, the scanning lines are driven sequentially in the sequence of red, green, blue, red, green, and blue in the sequence from the r-th to (r+5)th unit.

Figure 15:
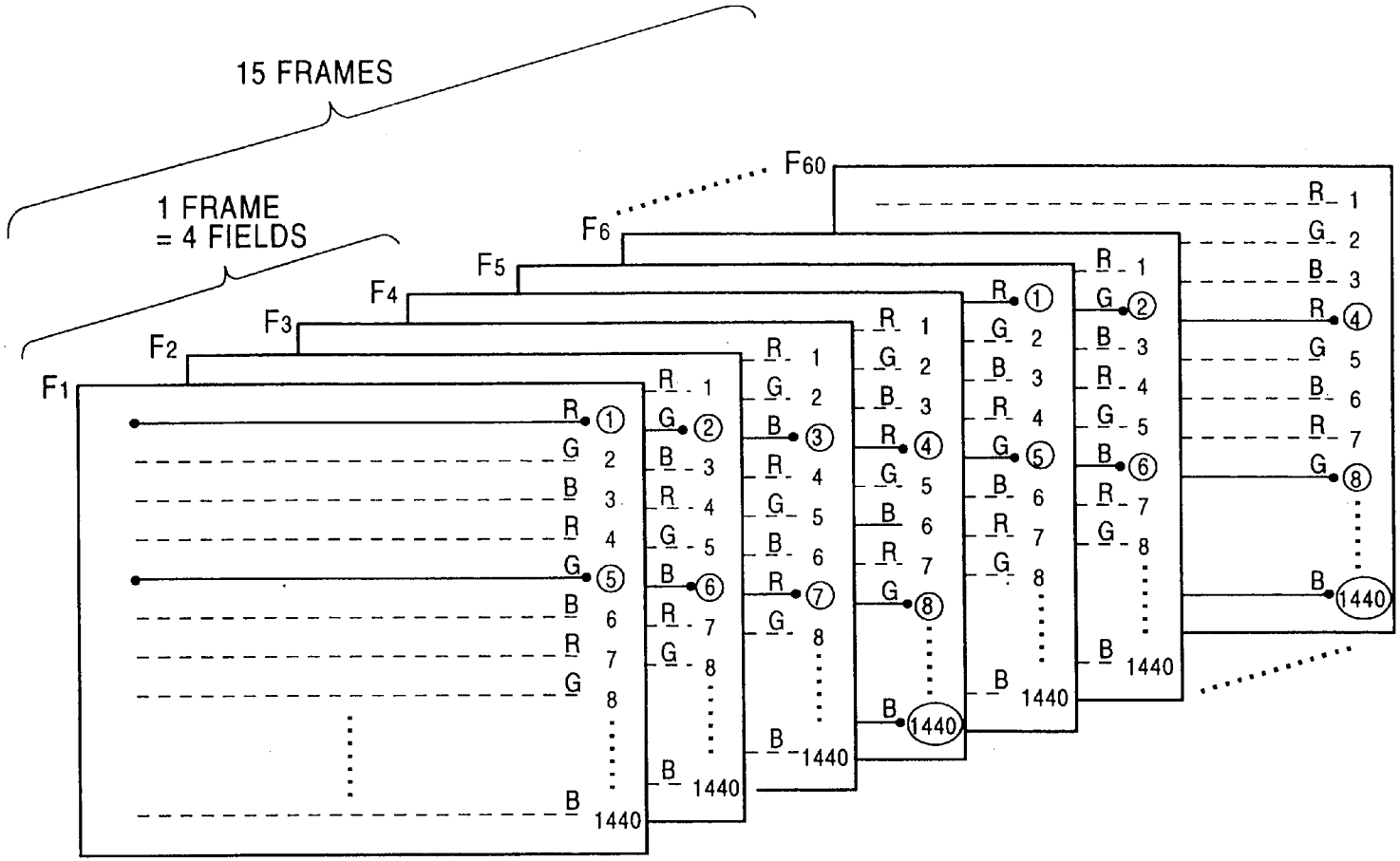
FIG. 15 is an illustration which shows an example of the relationship between the frame frequency and the fields when the display device is driven according to the present invention.

The four fields described above form one frame. The situation is shown in FIG. 15, which is an illustration showing an example of the relationship between the frame frequency and the fields when the display device is driven according to the present invention. As shown in the figure, one frame is formed of the above-described four fields ($F_1$ to $F_4$), and 15 frames are displayed in one second. That is, the number of fields displayed in one second is 4×15=60, which is the same as the number of fields shown in FIG. 5. In FIG. 15, the numerals ("1" to "1440") shown on the right end of each of the fields $F_1$ to $F_{60}$ are numerals which indicate the sequence number of each scanning line from the top when the topmost scanning line is denoted as "1". Further, the numerals encircled by the symbol "○" indicate the scanning lines driven within that field.

In this driving method, since the frequency at which the scanning lines are scanned is the same as in the conventional construction, the power consumption per gate driver is approximately 20 mW, and since six gate drivers with power consumptions of approximately 20 mW are required, the total power consumption is 120 mW. Further, three source drivers with power consumptions of approximately 100 mW are required. However, since one frame is divided into four fields and these four fields are interlace-scanned, their dot clock is ¼ of that of the conventional construction, and the power consumption per source driver is reduced to ¼ of its value, that is, 25 mW. Therefore, the resulting power consumed by the source drivers is 25×3=75 mW, and the power consumed by the gate drivers and the source drivers is 195 mW. Thus, the power consumption can be suppressed to about 23.2% of that of the conventional construction.

Further, as described above, the power consumption when the driving method shown in FIG. 6 or the driving method shown in FIGS. 10 to 12 is used is 220 mW. Since the power consumption is 195 mW when this driving method is used, the display device can be driven at a power consumption of about 88% with respect to the power consumption when the driving method shown in FIG. 6 or the driving method shown in FIGS. 10 to 12 is used.

Next, a description will be given of still another driving method in which the above-described problems, that is, both the problem of the contour of the display object being distorted and the problem of the occurrence of flicker are solved and further, the power consumption is reduced.

FIGS. 16, 17, and 18 are illustrations which show the method of driving the display device according to the present invention. This driving method differs from the driving method shown in FIGS. 13 and 14 in that the display device is driven with five scanning lines being one unit.

Also in this driving method, it is possible to make the scanning lines driven within each field evenly spaced. Also in this driving method, pixels in the horizontal stripe arrangement shown in FIG. 3 are used. In the following, for the sake of simplicity of description, a case in which a white display is produced by applying a voltage to all the dots which form the screen will be described.

FIG. 16A shows the first field when driven by this driving method. As shown in this figure, in this driving method, the scanning lines are driven at a rate of one for every five scanning lines. That is, as shown in FIG. 15A, in the first field, five scanning lines represent one unit, and the first scanning line of the scanning lines which form each unit is driven. In this case, as shown in the figure, a red scanning line is scanned in the s-th unit, a blue scanning line is scanned in the (s+1)th unit, a green scanning line is scanned in the (s+2)th unit, a red scanning line is scanned in the (s+3)th unit, and a blue scanning line is scanned in the (s+4)th unit in this sequence.

FIG. 16B shows the second field when driven by this method. As shown in this figure, in the second field, the second scanning line of the five scanning lines which represent one unit is scanned. In FIG. 16B, the scanning lines are driven sequentially in the sequence of green, red, blue, green, and red in the sequence from the s-th to (s+4)th unit.

FIG. 17A shows the third field when driven by this method. As shown in this figure, in the third field, the third scanning line of the five scanning lines which represent one unit is scanned. In FIG. 17A, the scanning lines are driven sequentially in the sequence of blue, green, red, blue, and green in the sequence from the s-th to (s+4)th unit.

FIG. 17B shows the fourth field when driven by this method. As shown in this figure, in the fourth field, the fourth scanning line of the five scanning lines which represent one unit is scanned. In FIG. 17B, the scanning lines are driven sequentially in the sequence of red, blue, green, red, and blue in the sequence from the s-th to (s+4)th unit.

FIG. 18 shows the fifth field when driven by this method. In this field, the remaining scanning lines are scanned. That is, in the fifth field, the fifth scanning line of the five scanning lines which represent one unit is scanned. In FIG. 18, the scanning lines are driven sequentially in the sequence of green, red, blue, green, and red (an illustration of the (s+4)th unit is omitted) in the sequence from the s-th to (s+4)th unit.

Figure 19:
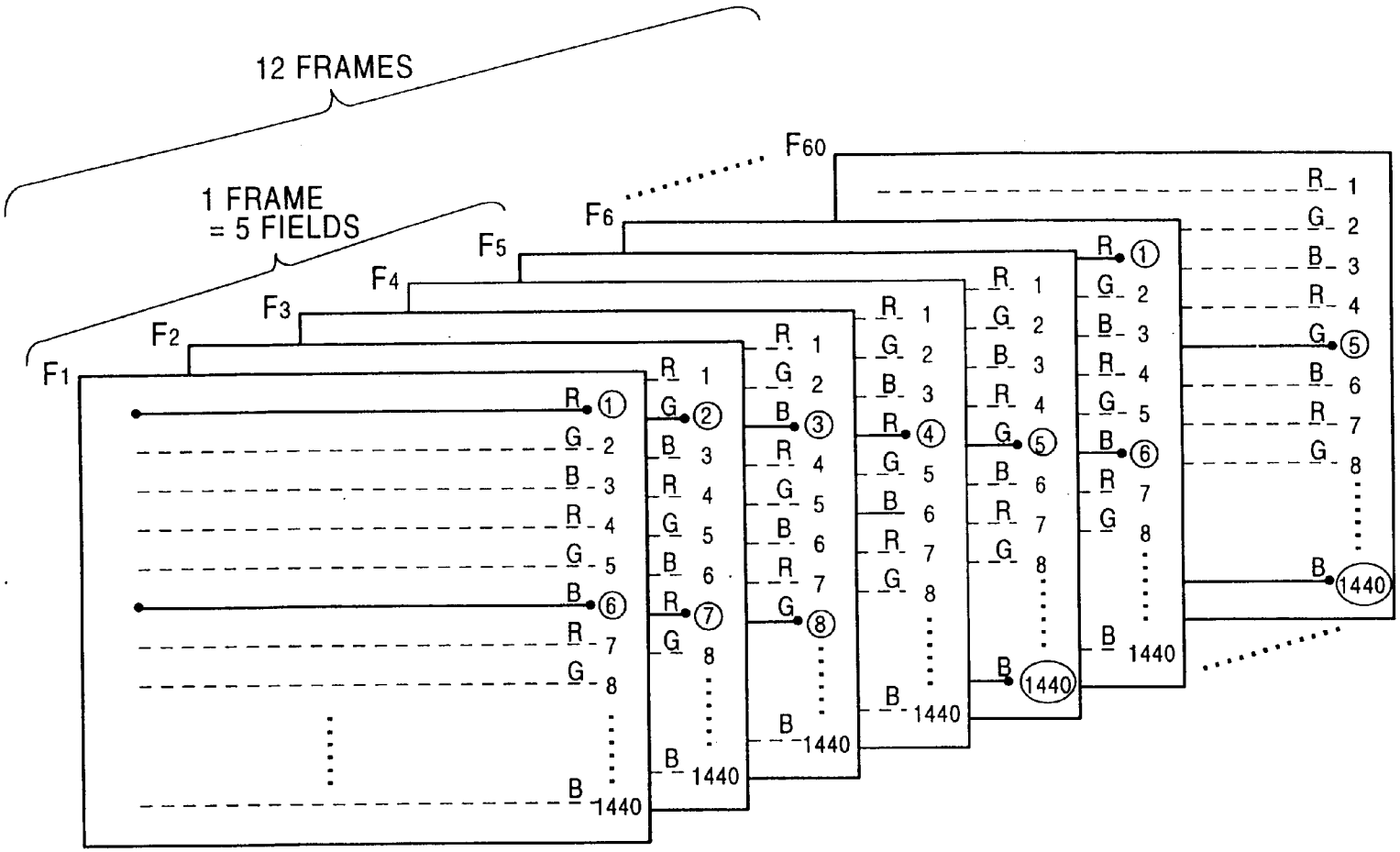
FIG. 19 is an illustration which shows still another example of the relationship between the frame frequency and the fields when the display device is driven according to the present invention.

The five fields described above form one frame. The situation is shown in FIG. 19 which is an illustration showing still another example of the relationship between the frame frequency and the fields when the display device is driven according to the present invention. As shown in the figure, one frame is formed of the above-described five fields ($F_1$ to $F_5$), and 12 frames are displayed in one second. That is, the number of fields displayed in one second is 5×12=60, which is the same as the number of fields shown in FIG. 5. In FIG. 19, the numerals ("1" to "1440") shown on the right end of each of the fields $F_1$ to $F_{60}$ are numerals which indicate the sequence number of each scanning line from the top when the topmost scanning line is denoted as "1". Further, the numerals encircled by the symbol "○" indicate the scanning lines driven within that field.

In this driving method, since the frequency at which the scanning lines are scanned is the same as in the conventional construction, the power consumption per gate driver is approximately 20 mW, and since six gate drivers with power consumptions of approximately 20 mW are required, the total power consumption is 120 mW. Further, three source drivers with power consumptions of approximately 100 mW are required. However, since one frame is divided into five fields and these five fields are interlace-scanned, their dot clock is ⅕ of that of the conventional construction, and therefore, the power consumption per source driver is reduced to ⅕ of its value, that is, 20 mW. Therefore, the resulting power consumed by the source drivers is 20×3=60 mW, and the power consumed by the gate drivers and the source drivers is 180 mW. Thus, the power consumption can be suppressed to about 21.4% of that of the conventional construction.

Further, as described above, the power consumption when the driving method shown in FIG. 6 or the driving method shown in FIGS. 10 to 12 is used is 220 mW. Since the power consumption is 180 mW when this driving method is used, the display device can be driven at a power consumption of about 82% with respect to the power consumption when the driving method shown in FIG. 6 or the driving method shown in FIGS. 10 to 12 is used. That is, use of this driving method makes it possible to suppress the power consumption even more.

As has been described up to this point, according to the present invention, by dividing one frame into a plurality of fields and by scanning for each field, the display device can be driven in the same way as driving in the conventional construction, and the power consumption can be reduced.

Further, since scanning is performed so that the mutually different basic colors are displayed for each scanning line in the fields and that the frame is formed of fields for the number of basic colors, the display color being different for each field, it is possible to prevent flicker and the like. Specifically, there is the advantage that a display can be made such that it can be viewed very easily.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures, and functions.

What is claimed is:

1. A method of driving a thin-film transistor liquid crystal display (TFT-LCD) device comprising pixels arranged in a matrix and containing dots of one of a plurality of basic colors such that each basic color is contained in each pixel, the basic colors being red (R), green (G), and blue (B), said dots being matrix-driven by scanning lines and signal lines, said dots arranged along each signal line and said pixels arranged repeatedly along said signal and scanning lines, each pixel having color filters covering each dot and forming an arrangement with a first sequence of R-G-B along each signal line and a second sequence of the same color along each scanning line, the arrangement of said color filters being the same in all said pixels, wherein the number of scanning lines is the number of pixels repeatedly arrayed along the signal lines multiplied by the number of basic colors, and the number of dots arrayed along each of the signal lines is the number of pixels arrayed along each of the signal lines multiplied by the number of basic colors, and the number of dots arrayed along each of the scanning lines is the number of pixels arranged along each of the scanning lines, wherein the TFT-LCD device has at least one gate driver with a plurality of gate outputs corresponding to the amount of scanning lines and at least one source driver with a plurality of source outputs corresponding to the amount of signal lines, said method comprising:

dividing a frame of display information into a first field, a second field, and a third field, wherein the pixels in each field are classified in the signal line direction according to the progression of n, n+1, n+2, n+3, n+4, . . . , and n+m, where m is any integer greater than or equal to 5, where n is the first pixel in the scanning and signal lines; and sequentially driving the first, second, and third fields by scanning a reduced number of said scanning lines to display the frame according to the display information, wherein, in the first field, red scanning lines are scanned in pixels n and n+3,
green scanning lines are scanned in pixels n+1 and n+4,
blue scanning lines are scanned in pixels n+2 and n+5, in the second field, green scanning lines are scanned in pixels n and n+3,
blue scanning lines are scanned in pixels n+1 and n+4,
red scanning lines are scanned in pixels n+2 and n+5, in the third field blue scanning lines are scanned in pixels n and n+3,
red scanning lines are scanned in pixels n+1 and n+4,
green scanning lines are scanned in pixels n+2 and n+5, and voltage polarity is reversed from one pixel to the next pixel along the signal lines and from one dot to the next dot along the scanning lines, wherein pixel n has positive voltage polarity.

2. A method of driving a thin-film transistor liquid crystal display (TFT-LCD) device according to claim 1, wherein the TFT-LCD device is a video graphics array for laterally displaying 640 pixels and vertically displaying 480 pixels.

3. A method of driving a thin-film transistor liquid crystal display (TFT-LCD) device comprising pixels arranged in a matrix and containing dots of one of a plurality of basic colors such that each basic color is contained in each pixel, the basic colors being red (R), green (G), and blue (B), said dots being matrix-driven by scanning lines and signal lines, said dots arranged along each signal line and said pixels arranged repeatedly along said signal and scanning lines, each pixel having color filters covering each dot and forming an arrangement having a first sequence of R-G-B along each signal line and a second sequence of the same color along each scanning line, the arrangement of said color filters being the same in all said pixels, wherein the number of scanning lines is the number of pixels repeatedly arrayed along the signal lines multiplied by the number of basic colors, and the number of dots arrayed along each of the signal lines is the number of pixels arrayed along each of the signal lines multiplied by the number of basic colors, and the number of dots arrayed along each of the scanning lines is the number of pixels arranged along each of the scanning lines, wherein the TFT-LCD device has at least one gate driver with a plurality of gate outputs corresponding to the amount of scanning lines and at least one source driver with a plurality of source outputs corresponding to the amount of signal lines, said method comprising:

dividing a frame of display information into a first field, a second field, a third field, and a fourth field, wherein the scanning lines are divided into units along the signal line direction, each unit having four scanning lines, the units classified according to the progression of r, r+1, r+2, r+3, r+4, . . . , and r+m, where m is any integer greater than or equal to 5, where r is the first unit; and sequentially driving the first, second, third, and fourth fields by scanning a reduced number of said scanning lines to display the frame according to the display information, wherein, in the first field, red scanning lines are scanned in units r and r+3,
green scanning lines are scanned in units r+1 and r+4,
blue scanning lines are scanned in units r+2 and r+5, in the second field, green scanning lines are scanned in units r and r+3,
blue scanning lines are scanned in units r+1 and r+4,
red scanning lines are scanned in units r+2 and r+5, in the third field, blue scanning lines are scanned in units r and r+3,
red scanning lines are scanned in units r+1 and r+4,
green scanning lines are scanned in units r+2 and r+5, and in the fourth field, red scanning lines are scanned in units r and r+3,
green scanning lines are scanned in units r+1 and r+4,
blue scanning lines are scanned in units r+2 and r+5.

4. A method of driving a thin-film transistor liquid crystal display (TFT-LCD) device according to claim 3, wherein the TFT-LCD device is a video graphics array for laterally displaying 640 pixels and vertically displaying 480 pixels.

5. A method of driving a thin-film transistor liquid crystal display (TFT-LCD) device comprising pixels arranged in a matrix and containing dots of one of a plurality of basic colors such that each basic color is contained in each pixel, the basic colors being red (R), green (G), and blue (B), said dots being matrix-driven by scanning lines and signal lines, said dots arranged along each signal line and said pixels arranged repeatedly along said signal and scanning lines, each pixel having color filters covering each dot and forming an arrangement having a first sequence of R-G-B along each signal line and a second sequence of the same color along each scanning line, the arrangement of said color filters being the same in all said pixels, wherein the number of scanning lines is the number of pixels repeatedly arrayed along the signal lines multiplied by the number of basic colors, and the number of dots arrayed along each of the signal lines is the number of pixels arrayed along each of the signal lines multiplied by the number of basic colors, and the number of dots arrayed along each of the scanning lines is the number of pixels arranged along each of the scanning lines, wherein the TFT-LCD device has at least one gate driver with a plurality of gate outputs corresponding to the amount of scanning lines and at least one source driver with a plurality of source outputs corresponding to the amount of signal lines, said method comprising:

dividing a frame of display information into a first field, a second field, a third field, a fourth field, and a fifth field, wherein the scanning lines are divided into units along the signal line direction, each unit having five scanning lines, the units classified according to the progression of s, s+1, s+2, s+3, . . . , s+m, where m is any integer greater than or equal to 4 where s is the first unit; and sequentially driving the first, second, third, fourth, and fifth fields by scanning a reduced number of said scanning lines to display the frame according to the display information, wherein, in the first field, red scanning lines are scanned in units s and s+3,
blue scanning lines are scanned in units s+1 and s+4,
green scanning lines are scanned in unit s+2, in the second field, green scanning lines are scanned in units s and s+3,
red scanning lines are scanned in units s+1 and s+4,
blue scanning lines are scanned in unit s+2, in the third field, blue scanning lines are scanned in units s and s+3,
green scanning lines are scanned in units s+1 and s+4,
red scanning lines are scanned in unit s+2, in the fourth field, red scanning lines are scanned in units s and s+3,
blue scanning lines are scanned in units s+1 and s+4,
green scanning lines are scanned in unit s+2, and in the fifth field, green scanning lines are scanned in units s and s+3,
red scanning lines are scanned in unit s+1,
blue scanning lines are scanned in unit s+2.

6. A method of driving a thin-film transistor liquid crystal display (TFT-LCD) device according to claim 5, wherein the TFT-LCD device is a video graphics array for laterally displaying 640 pixels and vertically displaying 480 pixels.

* * * * *

UNITED STATES PATENT AND TRADEMARK OFFICE

CERTIFICATE OF CORRECTION

PATENT NO. : 6,184,853 B1
DATED : February 6, 2001
INVENTOR(S) : Hiroyuki Hebiguchi et al.

It is certified that error appears in the above-identified patent and that said Letters Patent is hereby corrected as shown below:

Title page,
Item [73], insert -- LG. Philips LCD Co., Ltd., Seoul (KR).

Column 15,
Line 46, immediately after "field" insert -- , -- (comma).

Column 17,
Line 33, immediately after "equal to 4" insert -- , -- (comma).

Signed and Sealed this

First Day of July, 2003

JAMES E. ROGAN
*Director of the United States Patent and Trademark Office*